US007038440B2

(12) United States Patent
Cali' et al.

(10) Patent No.: US 7,038,440 B2
(45) Date of Patent: May 2, 2006

(54) METHOD OF LIMITING THE NOISE BANDWIDTH OF A BANDGAP VOLTAGE GENERATOR AND RELATIVE BANDGAP VOLTAGE GENERATOR

(75) Inventors: Giovanni Cali', Catania (IT); Pietro Filoramo, Siracusa (IT)

(73) Assignee: STMicroelectronics S.r.l., Agrate Brianza (IT)

( * ) Notice: Subject to any disclaimer, the term of this patent is extended or adjusted under 35 U.S.C. 154(b) by 0 days.

(21) Appl. No.: 11/008,470

(22) Filed: Dec. 9, 2004

(65) Prior Publication Data

US 2005/0151526 A1 Jul. 14, 2005

(30) Foreign Application Priority Data

Dec. 10, 2003 (EP) ..... 03425791

(51) Int. Cl.
*G05F 3/26* (2006.01)

(52) U.S. Cl. ..... 323/313; 323/315

(58) Field of Classification Search ..... 323/312, 323/313, 314, 315, 316; 327/530, 538, 539
See application file for complete search history.

(56) References Cited

U.S. PATENT DOCUMENTS

| | | | | |
|---|---|---|---|---|
| 4,349,778 | A | 9/1982 | Davis | 323/314 |
| 4,553,083 | A * | 11/1985 | Yang | 323/313 |
| 6,188,211 | B1 | 2/2001 | Rincon-Mora et al. | 323/280 |
| 6,462,526 | B1 | 10/2002 | Tanase | 323/313 |
| 6,799,889 | B1 * | 10/2004 | Pennock | 374/178 |
| 2002/0163378 | A1 | 11/2002 | Kadanka | 327/538 |

* cited by examiner

*Primary Examiner*—Adolf Berhane
(74) *Attorney, Agent, or Firm*—Lisa K. Jorgenson; Allen, Dyer, Doppelt, Milbrath & Gilchrist, P.A.

(57) ABSTRACT

A bandgap voltage generator includes an output node for providing an output voltage, a current mirror coupled between the output node and a voltage reference, and a biasing transistor coupled to the output node. A feedback line includes a feedback transistor coupled to the output node. A current generator biases the feedback transistor by injecting a current into a bias node of the feedback line. A capacitor is coupled between the bias node and the voltage reference. The feedback line includes a circuit coupled between the bias node and the feedback transistor for causing a current to flow through the feedback transistor, and for increasing a resistance of a portion of the feedback line in parallel to the capacitor.

27 Claims, 4 Drawing Sheets

METHOD OF LIMITING THE NOISE BANDWIDTH OF A BANDGAP VOLTAGE GENERATOR AND RELATIVE BANDGAP VOLTAGE GENERATOR

FIELD OF THE INVENTION

The invention relates to voltage generators, and in particular, to a method for limiting the noise bandwidth of a bandgap voltage generator and to a corresponding bandgap voltage generator providing a stable reference voltage with high immunity from noise at low frequency.

BACKGROUND OF THE INVENTION

Integrated circuits for telecommunications at radio frequencies are now even more sophisticated, and require, in particular, a good PSRR (Power Supply Rejection Ratio) and voltage reference sources that are nearly independent from noise and fluctuation of the supply voltage of the circuit.

Stable voltage references are generated by bandgap voltage generators that are substantially formed by connecting components among them to compensate the effects of fluctuation of the supply voltage and variations of the operating temperature of the device.

A typical bandgap voltage generator is depicted in FIG. 1. The functioning of this generator is well known and will not be explained in detail. According to common practice, the area n*A of the output transistor Q1 of the current mirror is "n" times the area A of the input transistor Q2, and the area A' of the feedback transistor Q3 of the bandgap voltage generator is $$A'=A^*(I_{Q3}/I_C) \tag{1}$$

where $I_{Q3}$ is the current flowing through the feedback transistor Q3.

By dimensioning the transistor Q3, its base-emitter voltage $V_{BE3}$ coincides with the base-emitter voltage $V_{BE2}$ of the transistor Q2. Therefore, the collector of the output transistor Q1 of the current mirror is kept indirectly at the same potential of the collector of the input transistor Q2 of the current mirror.

In certain applications a very low noise reference voltage is required. The expression "low noise" means not only "low noise at high frequency" but also "low noise at low frequency".

U.S. Pat. No. 6,462,526 discloses an architecture of a bandgap voltage generator having additional bipolar transistors for diverting part of the current flowing in the matched transistors of the voltage generator. The proposed architecture has good noise rejection figures, but the noise bandwidth at low frequency is relatively large.

Noise at high frequency may be easily filtered by using common integrated components, but it is much more difficult to curb low frequency noise. This kind of noise may significantly depress performances of certain high frequency circuits biased by the bandgap voltage generator, such as oscillators, mixers and other circuits. These circuits have nonlinear characteristics and therefore the input noise is likely to be folded or added back on the output band. In particular, nonlinear RF circuits need noise free voltage generators because input low frequency noise is added to frequency ranges in which carriers of signals to be transmitted/received normally belong.

For these reasons bandgap voltage bias generators with extremely low noise at ultra low frequencies (<100 Hz) are needed by manufacturers of oscillators and mixers for enhancing global performances of these circuits, such as spectral purity, and residual noise corruption of down-converted or up-converted signals.

FIG. 2 shows the same bandgap voltage generator of FIG. 1 in which noise sources have been indicated; $\overline{v^{*2}}$ is the voltage noise source of the resistor R*, and $\overline{v_{in}}^2$ and $\overline{i_{in}}^2$ are noise voltage and current sources of the bandgap generator at the emitter of Q1, respectively.

An equivalent circuit to that of FIG. 2 is depicted in FIG. 3, wherein the transistor Q4 replaces the current generator $I_{bias}$, and the equivalent noise current generator $\overline{i_{eq}}^2$ is equivalent to the three noise generators $\overline{v^{*2}}$, $\overline{v_{in}}^2$ and $\overline{i_{in}}^2$ of FIG. 2.

The power density of the noise corrupting the output voltage $V_{BG}$ is thus $$\overline{v_{nBG}^2} = \overline{i_{eq}^2}\cdot\left(\frac{R^*}{R^*+\frac{1}{gm_{Q1}}}\right)^2\cdot R_C^2\cdot\left(\frac{1}{\frac{V_T}{V_{AQ3}}+\frac{V_T}{V_{AQ4}}}\right)^2\cdot\frac{1}{H_r^2} \tag{2}$$

wherein $gm_{Q1}$ is the transconductance of the transistor Q1, $V_T$ is the thermal voltage, $V_{AQ3}$ and $V_{AQ4}$ are the respective Early voltages of the transistors Q3 and Q4, and $H_r$ is the open loop gain of the voltage generator.

By substituting $\overline{i_{eq}}^2$ with its value as a function of $\overline{v_{in}}^2$ and $\overline{i_{in}}^2$ assuming that the noise sources are uncorrelated, eq. (2) becomes $$\overline{v_{nBG}^2} = \left(\frac{4kT\cdot\Delta f}{R^*}+\frac{\overline{v_{in}}^2}{R^{*2}}+\overline{i_{in}^2}\right)\cdot\left(\frac{R^*}{R^*+\frac{1}{gm_{Q1}}}\right)^2\cdot R_C^2\cdot\left(\frac{1}{\frac{V_T}{V_{AQ3}}+\frac{V_T}{V_{AQ4}}}\right)^2\cdot\frac{1}{H_r^2} \tag{3}$$

wherein k is Boltzmann's constant, T is the temperature of the bandgap voltage generator, and Δf is a frequency interval.

The ratio $R_C/R^*$ is fixed, thus the bandgap noise voltage decreases when R* decreases, or in other words, when the bandgap current $I_C$ increases. This assumption is valid as long as the current shot noise of transistors is negligible. For this reason, very often the transistors Q1 and Q2 are designed for having high collector currents $I_C$ for reducing the output noise corrupting the voltage reference $V_{BG}$.

The noise bandwidth is determined by the noise filtering capacitor $C_C$ and the equivalent resistance $R_{Cc}$ seen from the nodes of the capacitor $C_C$. The resistance $R_{Cc}$ is given by the following formula $$R_{Cc} \cong (r_{0Q3} // r_{0Q4})\cdot\frac{1}{H_r} \tag{4}$$

wherein $r_{0Q3}$ and $r_{0Q4}$ are the respective output resistances of transistors Q3 and Q4. Thus $$R_{Cc} \cong \frac{1}{I_{Q3,bias}} \cdot \frac{1}{\frac{1}{V_{AQ3}} + \frac{1}{V_{AQ4}}} \cdot \frac{1}{H_r} \tag{5}$$

where $I_{Q3}=I_{bias}$ is the current flowing through the transistor Q3.

The noise bandwidth is $$f_n = \frac{1}{2\pi \cdot \frac{1}{I_{Q3,bias}} \cdot \frac{1}{\frac{1}{V_{AQ3}} + \frac{1}{V_{AQ4}}} \cdot \frac{1}{H_r} \cdot C_C} \tag{6}$$

Looking at this equation, it is clear that the noise bandwidth is reduced by keeping the current $I_{Q3}=I_{bias}$ as small as possible.

The transistors Q3 and Q2 are matched according to eq. (1) and a small bias would imply: a small bandgap current $I_C$, which ideally should be as large as possible for reducing noise intensity; or a small current ratio $I_{Q3}/I_C$, which means using transistors Q1 and Q2 with very large emitters. However, it is very difficult to ensure a good match between transistors Q2 and Q3 when the area ratio A/A' is very large.

SUMMARY OF THE INVENTION

In view of the foregoing background, an object of the invention is to limit the noise bandwidth of a bandgap voltage generator.

It is not mandatory to reduce the current flowing in the feedback transistor of the voltage generator for limiting the bandwidth of noise at low frequency. In contrast, the objective may be attained by increasing the equivalent resistance seen from the nodes of the noise filtering capacitor while keeping relatively high the current flowing in the feedback transistor.

The method in accordance with the invention is very effective because the noise bandwidth, which is inversely proportional to the product between the capacitance of the noise filtering capacitor and the resistance in parallel therewith, is reduced without rendering it difficult matching of the feedback transistor with the input transistor of the current mirror of the voltage generator because of an excessively small current ratio.

The method in accordance with the invention may be implemented by adding a circuit between the feedback transistor and the noise filtering capacitor, which forces a certain current through the feedback transistor while increasing the equivalent resistance in parallel to the noise filtering capacitor.

More precisely, this and other objects, advantages and features in accordance with the invention are provided by a method of limiting the noise bandwidth of a closed loop bandgap voltage generator generating a stable voltage reference on an output node. A current mirror is coupled between the output node and ground, and a feedback line includes a conducting feedback transistor coupled to an output branch of the current mirror. The feedback transistor may cooperate with a biasing transistor of the current mirror for keeping constant the collector or drain voltage of the output transistor of the current mirror. The feedback transistor may be dimensioned to have the same base-emitter or gate-source voltage of the diode-connected input transistor of the current mirror. A current generator may bias the feedback transistor by injecting a current into a bias node of the feedback line, and a noise filtering capacitor may be connected between the bias node and ground.

The method substantially forces a certain current through the feedback transistor and increases the resistance of the portion of the feedback line parallel to the capacitor.

The method may be implemented in a bandgap voltage generator, the feedback line of which comprises a circuit connected between the bias node and the feedback transistor for forcing a certain current through the feedback transistor and increasing the resistance of the portion of feedback line in parallel to the capacitor.

BRIEF DESCRIPTION OF THE DRAWINGS

The various aspects and advantages of the invention will become even more evident through the following description of an embodiment referring to the attached drawings, wherein.

DETAILED DESCRIPTION OF THE PREFERRED EMBODIMENTS

Figure 4:
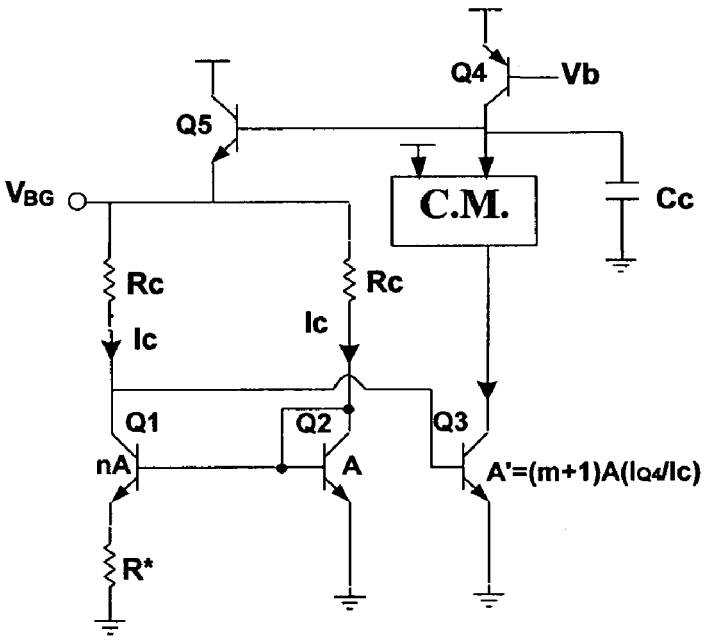
FIG. 4 schematically illustrates a basic bandgap voltage generator according to the invention.
Figure 5:
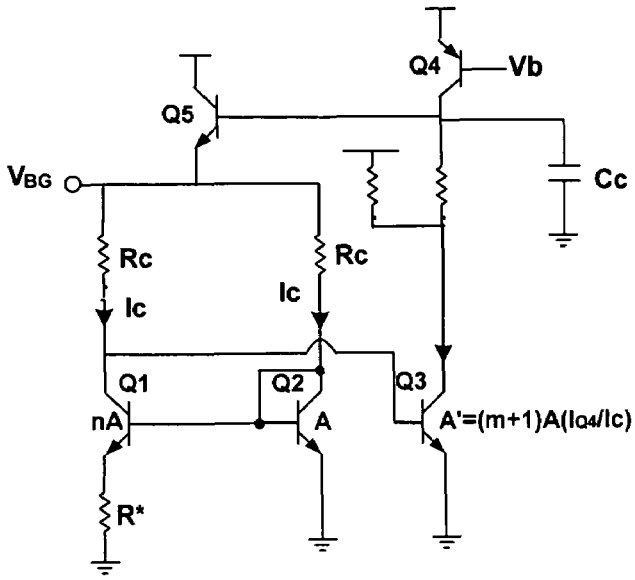
FIG. 5 schematically illustrates one embodiment of the invention.

The problems already discussed above are overcome by forming a closed-loop bandgap voltage generator according to the invention, as depicted in FIG. 4. The circuit of the bandgap voltage generator of the invention differs from the circuit of the bandgap voltage generator of FIG. 1 by comprising an additional circuit block CM in the feedback line. The block CM is a circuit connected to the supply node of the voltage generator that forces a current through the feedback transistor Q3, and at the same time increases the equivalent resistance in parallel to the noise filtering capacitor $C_C$ for limiting the noise bandwidth.

The block CM may be formed by a pair of resistors having a common node, for example, with one resistor being connected to the supply node and the other resistor being connected in series to the feedback transistor Q3. As an alternative, the block CM may be formed by replacing the resistor connected to the supply with a current generator.

Figure 6:
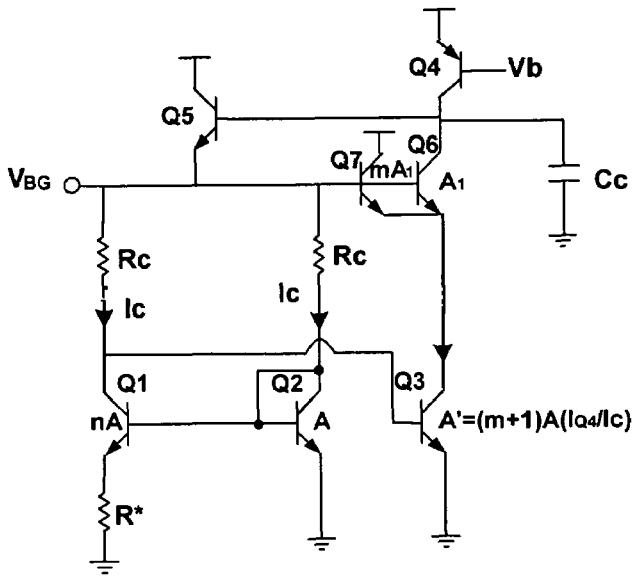
FIG. 6 schematically illustrates another embodiment of the invention.

Among the numerous alternative ways of implementing the functions of the block CM, a very straightforward and effective architecture of the bandgap voltage generator of the invention is depicted in FIG. 6. In this case, the block CM may be formed by two transistors Q6 and Q7 permanently biased in a conduction state by a fixed voltage, which may be the same output bandgap voltage reference $V_{BG}$ of the voltage generator.

The transistor Q7 is m times larger than transistor Q6 and so a current m times larger flows in Q7 than in transistor Q6. Therefore, the transistor Q7 provides a by-pass or shunt current path with respect to the bias current path formed by the current generator Q4 and transistor Q6. In other words, the transistor Q7 forms an additional bias current generator that cooperates with the transistor Q4 in forcing a certain bias current in the feedback transistor Q3.

The current $I_{Q3}$ that flows in through the feedback transistor Q3 of the voltage generator of FIG. 6 is provided by the current generator Q4 and by Q7. Therefore, the current $I_{bias}$ of the current generator Q4 may be made relatively small while keeping constant the current $I_{Q3}$ by increasing a similar amount the current supplied to Q3 by the transistor Q7.

Using this approach, the current flowing in the transistor $I_{Q3}$ may be kept large enough for allowing matching of the transistors Q3 and Q2 with good precision. Moreover, by reducing the current $I_{bias}$ that flows in the transistor Q6 renders its output resistance relatively large, and thus the equivalent resistance in parallel to the noise filtering capacitor $C_C$ is effectively increased.

The noise bandwidth of the voltage generator of FIG. 6 is $$f_n = \frac{1}{2\pi \cdot \frac{1}{I_{bias}} \cdot \frac{1}{\frac{1}{V_{AQ4}} + \frac{1}{V_{AQ6}}} \cdot \frac{1}{H_r} \cdot C_C} \tag{7}$$

Figure 1:
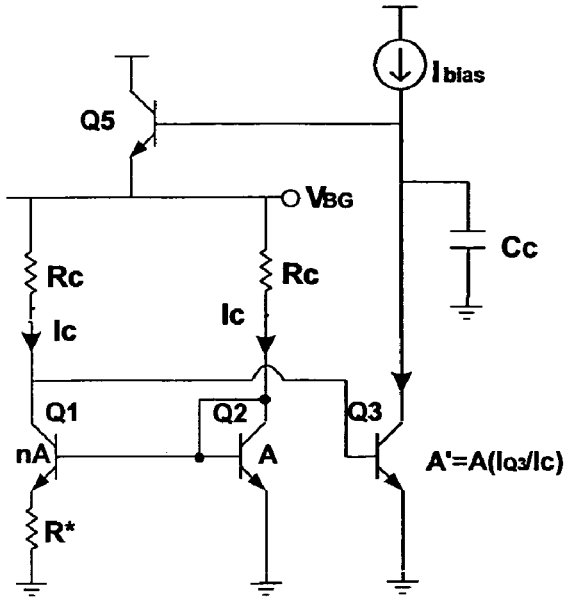
FIG. 1 (PRIOR ART)
FIG. 1 schematically illustrates a bandgap voltage generator according to the prior art.
Figure 2:
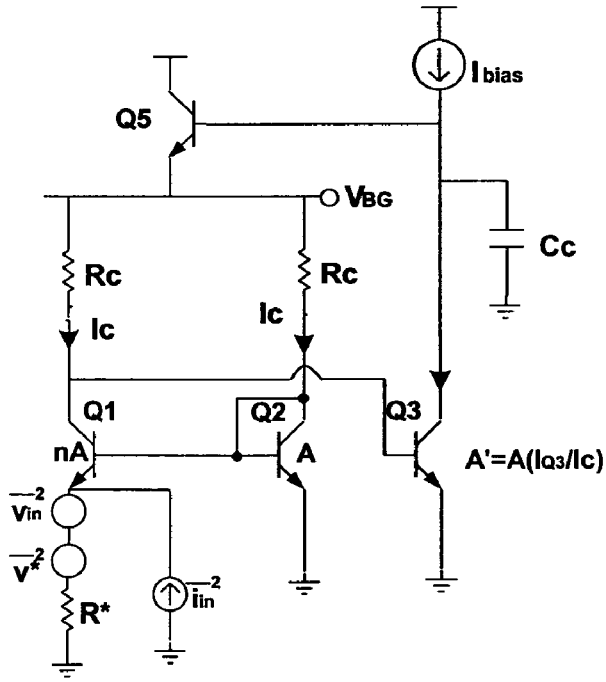
FIG. 2 (PRIOR ART)
FIG. 2 schematically illustrates the voltage generator of FIG. 1 with an indication of the relative noise sources.
Figure 3:
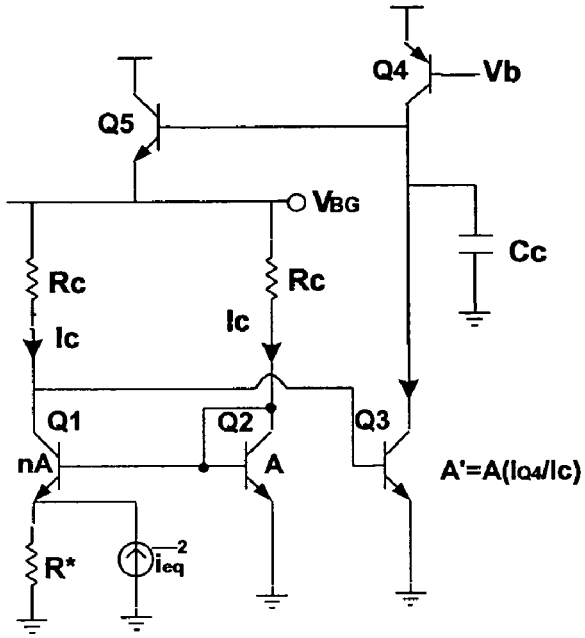
FIG. 3 (PRIOR ART)
FIG. 3 schematically illustrates a simpler equivalent noise source in the circuit of FIG. 2.

Recalling that the current $I_{bias}$ generated by Q4 is m+1 times smaller than the current $I_{Q3}$ that flows in the feedback transistor Q3, the noise bandwidth is $$f_n = \frac{1}{(m+1) \cdot 2\pi \cdot \frac{1}{I_{Q3}} \cdot \frac{1}{\frac{1}{V_{AQ4}} + \frac{1}{V_{AQ6}}} \cdot \frac{1}{H_r} \cdot C_C} \tag{8}$$

which is about m+1 times smaller than that of the known circuit of FIG. 1.

The above formula is obtained by neglecting the output resistance $r_{0Q3}$ of the feedback transistor Q3. In fact, $r_{0Q3}$ is much smaller than the output resistances $r_{0Q4}$ and $r_{0Q6}$ of transistors Q4 and Q6, respectively, because the current $I_{bias}$ flowing through these transistors is much smaller than the current flowing through the feedback transistor Q3.

The advantages of the voltage generator of the invention are even more evident considering that with the prior art voltage generator of FIG. 1, a noise bandwidth equivalent to that of eq. (8) could be attained only with a noise filtering capacitor m+1 times larger than that of the voltage generator of FIG. 6. This would penalize the silicon area requirement.

Figure 7:
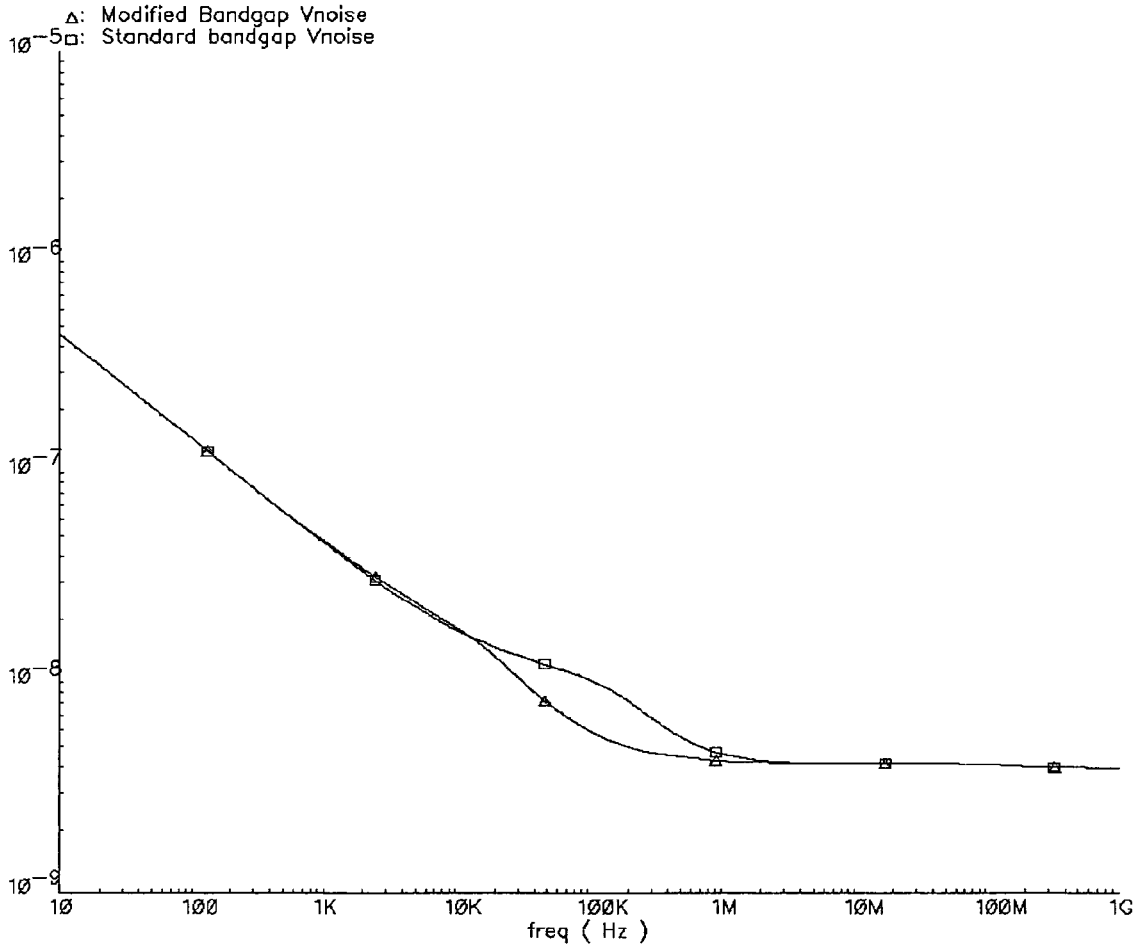
FIG. 7 is a Bode diagram comparing the noise bandwidth of the circuits of FIGS. 1 and 6.

A Bode diagram of the frequency responses of the bandgap voltage generator of FIGS. 1 and 6 are compared in FIG. 7. The Bode diagram has been calculated by simulation using the following parameters:

$I_{CQ1,2}$=200 μA; $I_{CQ3}$=10 μA; $C_C$=200 pF; m=9

The noise bandwidth of the bandgap voltage generator of the invention is about m+1 (ten) times narrower than that of the voltage generator of FIG. 1.

It is not practicable to use larger values of m in BJT technology because bipolar junction transistors absorb a non-null base current. If an excessively large value of m is chosen, the current flowing through Q4 becomes so small that a relevant proportion thereof flows through the base of the transistor Q5, thus disturbing the correct functioning of the bandgap voltage generator.

According to a preferred embodiment, the bandgap voltage generator of the invention is formed using MOS transistors instead of BJTs. MOS transistors do not absorb any current from their control node (gate), and thus there is no such limitation on the maximum practicable value of m. Simulations of the functioning of the generator of FIG. 6 formed using MOS transistors have been carried out, showing that it is possible to reduce even by more than two decades the noise bandwidth at low frequency.

What is claimed is:

1. A closed loop bandgap voltage generator for generating a stable output voltage on an output node thereof, and comprising:

a current mirror coupled between the output node and a voltage reference, said current mirror comprising an output branch coupled to the output node, an output transistor coupled to said output branch, and an input transistor configured as a diode coupled to said output transistor;

a biasing transistor coupled to said output branch;

a feedback line comprising a first feedback transistor coupled to said output branch and cooperating with said biasing transistor for keeping constant a conducting terminal voltage of said output transistor, said first feedback transistor being dimensioned to have a control terminal/conducting terminal voltage substantially the same as a control terminal/conducting terminal voltage of said input transistor;

a current generator for biasing said first feedback transistor by injecting a current into a bias node of said feedback line;

a noise filtering capacitor coupled between the bias node and the voltage reference; and said feedback line comprising a circuit coupled between the bias node and said first feedback transistor for causing a current to flow through said first feedback transistor, and for increasing a resistance of a portion of said feedback line in parallel to said noise filtering capacitor.

2. A closed loop bandgap voltage generator according to claim 1, wherein said circuit comprises:

a second feedback transistor coupled in series to said first feedback transistor, and being permanently biased in a conduction state by a fixed control voltage; and a third transistor being permanently biased in a conduction state by the fixed control voltage, and shunting said second feedback transistor and said current generator.

3. A closed loop bandgap voltage generator according to claim 2, wherein said third transistor is a scaled replica of said first feedback transistor.

4. A closed loop bandgap voltage generator according to claim 2, wherein the fixed control voltage is equal to the stable output voltage.

5. A closed loop bandgap voltage generator according to claim 2, wherein said output transistor, said input transistor, said biasing transistor and said first feedback transistor each comprises a MOS transistor.

6. A closed loop bandgap voltage generator according to claim 5, wherein the control terminal/conducting terminal voltage of said input and first feedback transistors correspond to a gate/source voltage.

7. A closed loop bandgap voltage generator according to claim 1, wherein the voltage reference comprises ground.

8. A bandgap voltage generator comprising:

an output node for providing an output voltage;

a current mirror coupled between said output node and a voltage reference;

a biasing transistor coupled to said output node;

a feedback line comprising a first feedback transistor coupled to said output node;

a current generator for biasing said first feedback transistor by injecting a current into a bias node of said feedback line;

a capacitor coupled between the bias node and the voltage reference; and said feedback line comprising a circuit coupled between the bias node and said first feedback transistor for causing a current to flow through said first feedback transistor, and for increasing a resistance of a portion of said feedback line in parallel to said capacitor, said circuit comprising a second feedback transistor coupled in series to said first feedback transistor, and a third transistor shunting said second feedback transistor and said current generator.

9. A bandgap voltage generator according to claim 8, wherein said current mirror comprises an output transistor coupled to said output node, and an input transistor configured as a diode coupled to said output transistor.

10. A bandgap voltage generator according to claim 9, wherein said first feedback transistor cooperates with said biasing transistor for keeping constant a conducting terminal voltage of said output transistor.

11. A bandgap voltage generator according to claim 9, wherein said first feedback transistor is dimensioned to have a control terminal/conducting terminal voltage substantially the same as a control terminal/conducting terminal voltage of said input transistor.

12. A bandgap voltage generator according to claim 8, wherein said second feedback transistor is permanently biased in a conduction state by a fixed control voltage; and wherein said third transistor is also permanently biased in a conduction state by the fixed control voltage.

13. A bandgap voltage generator according to claim 8, wherein said third transistor is a scaled replica of said first feedback transistor.

14. A bandgap voltage generator according to claim 12, wherein the fixed control voltage is equal to the output voltage.

15. A bandgap voltage generator according to claim 8, wherein said output transistor, said input transistor, said biasing transistor, said first and second feedback transistors, and said third transistor each comprises a MOS transistor.

16. A bandgap voltage generator according to claim 15, wherein the control terminal/conducting terminal voltage of said input and first feedback transistors correspond to a gate/source voltage.

17. A bandgap voltage generator according to claim 8, wherein the voltage reference comprises ground.

18. A method for limiting the noise bandwidth of a closed loop bandgap voltage generator generating an output voltage on an output node thereof, the bandgap voltage generator comprising a current mirror coupled between the output node and a voltage reference, a biasing transistor coupled to the output branch; and a feedback line comprising a feedback transistor coupled to the output node, the method comprising:

biasing the feedback transistor by injecting a current into a bias node of the feedback line;

filtering noise from the feedback line with a noise filtering capacitor coupled between the bias node and the voltage reference; and operating a circuit between the bias node and the feedback transistor for causing a current to flow through the feedback transistor, and for increasing a resistance of a portion of the feedback line in parallel to the noise filtering capacitor.

19. A method according to claim 18, wherein the biasing is performed by a current generator coupled to the output node so that the feedback transistor cooperates with the biasing transistor for keeping constant a conducting terminal voltage of the output transistor.

20. A method according to claim 18, wherein the current mirror comprises an output transistor coupled to the output node, and an input transistor configured as a diode coupled to the output transistor.

21. A method according to claim 20, wherein the feedback transistor is dimensioned to have a control terminal/conducting terminal voltage substantially the same as a control terminal/conducting terminal voltage of the input transistor.

22. A method according to claim 19, wherein the circuit comprises a second feedback transistor coupled in series to the feedback transistor; and a third transistor shunting the second feedback transistor and the current generator.

23. A method according to claim 22, wherein the second feedback transistor is permanently biased in a conduction state by a fixed control voltage; and further comprising permanently biasing the third transistor in a conduction state with a fixed control voltage.

24. A method according to claim 22, wherein the third transistor is a scaled replica of the feedback transistor.

25. A method according to claim 22, wherein the fixed control voltage is equal to the output voltage.

26. A method according to claim 22, wherein the feedback transistor and the third transistor each comprises a MOS transistor.

27. A method according to claim 18, wherein the voltage reference comprises ground.

* * * * *

UNITED STATES PATENT AND TRADEMARK OFFICE

CERTIFICATE OF CORRECTION

PATENT NO. : 7,038,440 B2
APPLICATION NO. : 11/008470
DATED : May 2, 2006
INVENTOR(S) : Giovanni Cali' and Pietro Filoramo It is certified that error appears in the above-identified patent and that said Letters Patent is hereby corrected as shown below:

| | |
|---|---|
| | Delete: "claim 22" |
| Column 8, Line 49 | Insert: -- claim 23 -- |

Signed and Sealed this

Third Day of July, 2007

JON W. DUDAS
*Director of the United States Patent and Trademark Office*